US006909219B2

(12) United States Patent
Takahashi et al.

(10) Patent No.: US 6,909,219 B2
(45) Date of Patent: Jun. 21, 2005

(54) CARBON BRUSH FOR ELECTRIC MACHINE

(75) Inventors: Kazuhiro Takahashi, Kagawa (JP); Masayuki Takuma, Kagawa (JP); Koji Kuroda, Kagawa (JP)

(73) Assignee: Totankako Co., Ltd., Toyonaka (JP)

( * ) Notice: Subject to any disclaimer, the term of this patent is extended or adjusted under 35 U.S.C. 154(b) by 0 days.

(21) Appl. No.: 10/311,323

(22) PCT Filed: Jun. 15, 2001

(86) PCT No.: PCT/JP01/05162

§ 371 (c)(1),
(2), (4) Date: Apr. 7, 2003

(87) PCT Pub. No.: WO02/01681

PCT Pub. Date: Jan. 3, 2002

(65) Prior Publication Data

US 2003/0155837 A1 Aug. 21, 2003

(30) Foreign Application Priority Data

Jun. 28, 2000 (JP) ..... PCT/JP00/04231

(51) Int. Cl.[7] ..... H01R 39/26; H01R 39/18

(52) U.S. Cl. ..... 310/251; 310/252; 310/253; 310/248

(58) Field of Search ..... 310/253, 245, 310/251, 252, 248; 428/611; 29/596–598

(56) References Cited

U.S. PATENT DOCUMENTS 3,980,914 A * 9/1976 Cunningham ..... 310/251
4,000,430 A * 12/1976 Bely et al. ..... 310/251
5,136,198 A * 8/1992 Shibuya ..... 310/251
5,387,831 A * 2/1995 Yang ..... 310/242
6,091,051 A * 7/2000 Morigami et al. ..... 219/216
6,245,440 B1 * 6/2001 Kuhlmann-Wilsdorf et al. . 428/611
6,268,679 B1 * 7/2001 Reynvaan et al. ..... 310/248

FOREIGN PATENT DOCUMENTS

JP 02051345 A * 2/1990 ..... H02K/13/00
JP 03071582 A * 3/1991 ..... H01R/39/26
JP 5-182733 7/1993
JP 05182733 A * 7/1993 ..... H01R/39/26
JP 6-22506 1/1994
JP 6-165442 6/1994
JP 6-189505 7/1994
JP 6-335206 12/1994
JP 8-223869 8/1996
JP 8-242559 9/1996
JP 9-215275 8/1997
JP 02000197315 * 7/2000 ..... H02K/13/00

* cited by examiner

*Primary Examiner*—Karl Tamai
*Assistant Examiner*—Leda Pham
(74) *Attorney, Agent, or Firm*—Oblon, Spivak, McClelland, Maier & Neustadt, P.C.

(57) ABSTRACT

Molybdenum disulfide, tungsten disulfide or the like as a solid lubricant and any of alumina, silica, silicon carbide or the like as an abrasive are added to filter graphite. A metal of good electric conductor is coated over the whole surface of a carbon brush material except a part of the carbon brush material to be contacted with a commutator. When the commutator rotates clockwise, a metal coating of the good electric conductor is removed mechanically from at least a part of at least either of a left side surface or a right side surface.

10 Claims, 4 Drawing Sheets

FIG. 7

| | Constitution of brush | Resistivity of brush material μΩ · m | Thickness of metal coating μm | Wearing rate mm/100h | Apparent resistivity μΩ · m | Temperature of brush ℃ |
|---|---|---|---|---|---|---|
| Ex. 1 | C + resin + $WS_2$ + SiC + Cu-plating | 500 | 10 | 3.3 | 70 | 120 |
| Ex. 2 | C + resin + $WS_2$ + SiC + Cu-plating | 100 | 10 | 4.0 | 40 | 118 |
| Ex.3 | C + resin + $MoS_2$ + SiC + Cu-plating | 2000 | 10 | 3.0 | 100 | 125 |
| Compara. Ex. 1 | C + resin + $WS_2$ + SiC | 500 | - | 5.0 | 500 | 145 |
| Compara. Ex. 2 | C + resin + Cu-plating | 500 | 10 | 5.5 | 70 | 120 |
| Compara. Ex. 3 | C + resin + $WS_2$ + SiC + Cu-plating | 60 | 10 | 6.0 | 20 | 115 |

CARBON BRUSH FOR ELECTRIC MACHINE

TECHNICAL FIELD

The present invention relates to a carbon brush for electric machinery and, more particularly, to a carbon brush for commutator motor, such as an electric vacuum cleaner and a power tool, for which high power and high-velocity revolution is required.

BACKGROUND ART

In recent years, a carbon brush for an electric machine intended for a commutator motor (hereinafter it is simply referred to as "the brush") has progressed on to miniaturization, high-power and high-velocity revolution. Accordingly, the brush of compact, less wearing, and less-temperature-rise under the high electric current density has been increasingly required.

However, the existing brushes have the tendency that under the high electric current density and high-velocity revolution, their commutating properties deteriorate to produce increase in wearing and temperature rise of the brush. Accordingly, the miniaturization of the brush is not advanced so remarkably in the present situation as the miniaturization of the commutator.

As it is generally known, when the brush of high resistivity is used for the commutator motor, reliable rectification is obtained. This is because the brush of high resistivity prevents short-circuit current from flowing between adjacent commutators by way of the brush. On the other hand, when material of high resistivity is used, the brush itself resistance heating and produces an increased temperature due to the high resistivity. Further, as the motor is increasingly advanced on to high-power, miniaturization and high-velocity revolution, the current flowing through the commutator increases and thus the temperature of the commutator increases. Due to this, an excessive coating of the commutator could produce stick-slip and in turn produces an increased commutation spark, then causing a further increase in temperature and wearing of the brush.

In the electric machinery of high revolution speed such as an electric vacuum cleaner, a resin-bonded brush comprising graphite powder bonded by a binder is sometimes used as demanded, in order to provide improved rectification and provide a brush free from replacement during the use of the electric vacuum cleaner body. However, as a result of a long hours use of the cleaner, the temperature rise is produced, then creating a vicious circle that the lubricating property of the brush itself is deteriorated to produce further temperature rise.

In Japanese Laid-open Patent Publication No. Hei 5(1993)-182733, the inventors disclosed the technical improvement that a metal having good electrical conducting properties, such as nickel, copper, gold and silver, is coated over outer surfaces of the brush material, whereby an apparent resistance is decreased to thereby suppress the temperature rise. Although this technical improvement of Japanese Laid-open Patent Publication No. Hei 5(1993)-182733 can suppress the temperature rise to some extent, it cannot be said to be sufficient for the temperature rise resulting from the high power and high-velocity revolution in recent years.

On the other hand, Japanese Laid-open Patent Publication No. Hei 2-51345 discloses a method of producing the brush, according to which for the purpose of keeping lubricating properties of the brush under temperature as high as the brush temperature reaches, a solid lubricant agent, such as molybdenum disulfide or tungsten disulfide, and an abrasive are granulated and then added to a thermosetting resin and the mixture is applied to the brush material to thereby produce the brush. However, this method cannot be said to be sufficient for the temperature rise resulting from the high power and high-velocity revolution in recent years, either.

Accordingly, it is an object of the present invention to provide a carbon brush for electric machinery of less temperature rise and excellent wear resistance to meet the demand of high power and high-velocity revolution.

DISCLOSURE OF THE INVENTION

The present invention provides a carbon brush for electric machinery wherein a metal coating of good electric conductor is formed on carbon brush material comprising a solid lubricant and an abrasive. Preferably, the carbon brush material has electric resistivity of not less than 100 $\mu\Omega\cdot$m. Also, it is preferable that an oxidation resisting coating is formed on a surface of the metal coating of good electric conductor.

The present invention provides a carbon brush for electric machinery which is to be abutted in a perpendicular direction with respect to a conductive rotary member, wherein a metal coating of good electric conductor is formed on a surface of carbon brush material of the carbon brush, and at least a part of at least either of a left side of the carbon brush of the clockwise conductive rotary member or a right side of the carbon brush of the counterclockwise conductive rotary member is an area in which the metal coating of good electric conductor is not formed and from which the carbon brush material is exposed. It is preferable that the at least a part of a contrary surface of a surface to which the carbon brush material is exposed is the area from which the carbon brush material is exposed. Also, it is preferable that the area from which the carbon brush material is exposed is formed in the manner that after the metal coating of good electric conductor is formed on all surfaces of the carbon brush orthogonal to the conductive rotary member, the coating is removed by a machine working.

According to the brush of the present invention, since at least one of molybdenum disulfide, tungsten disulfide, graphite fluoride, boron nitride and the like is added singly or in combination as the solid lubricant agent, improvement in lubricant property under high temperature can be produced. Further, at least one of alumina, silica, silicon carbide and the like is used singly or in combination as the abrasive. This enables the brush to have the function of regulating the thickness of the coating of insulation formed on the conductive rotary member such as the commutator. This can provide the result that the brush which is very low in wearing rate as compared with the existing brushes can be produced, and as such can allow the stable commutating property to be maintained for a long term.

Further, since the metal of good electric conductor, such as nickel, copper, gold and silver, is formed on the surfaces of the brush, the temperature rise is suppressed by the effect of the metallic coating even in the material having the electric resistivity of not less than 100 $\mu\Omega\cdot$m of good commutating performance.

Moreover, the metal coating of the good electric conductor is not formed in at least a part of at least either of a left either of a left side of the carbon brush of the clockwise conductive rotary member or a right side of the carbon brush of the counterclockwise conductive rotary member such as the commutator. Therefore, the metal coating can be prevented from being stripped off and cut into the conductive rotary member such as the commutator, and it becomes rare to damage a surface of the conductive rotary member.

BRIEF DESCRIPTION OF THE DRAWINGS

FIG. 7 is a table representing all attributes of examples of the brush of the present invention.

BEST MODE FOR CARRYING OUT OF THE INVENTION

Figure 1:
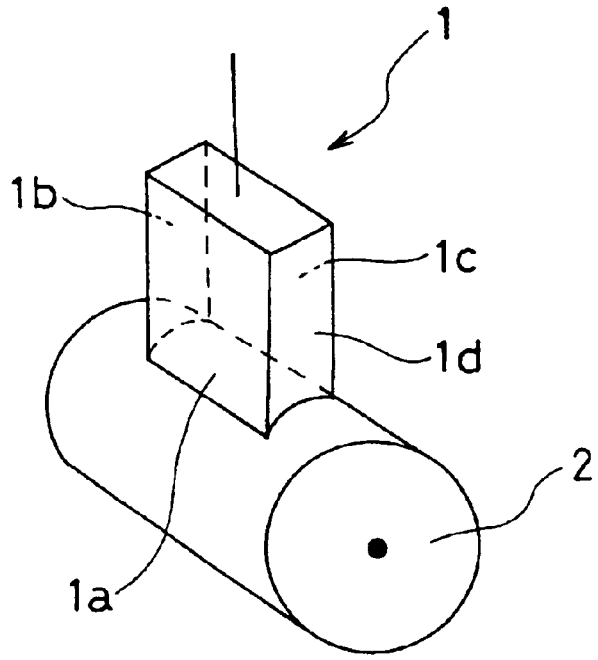
FIG. 1 is a schematic perspective view of a commutator motor in which the brush of the present invention is used, showing that a copper coating having good electrically conductive properties is formed over all side surfaces of the brush orthogonal to a rotation direction of a commutator.

The graphite that may be used for the brush material in the present invention include, for example, natural graphite, exfoliated graphite, and artificial graphite. Among others, the artificial graphite which is not so high in crystallinity is particularly preferable. The use of the artificial graphite enables the brush material to have a desired electric resistivity by adjusting the mixing conditions of the artificial graphite and baking conditions of the same in the production stages.

For stably maintaining the lubricating property of the brush at high temperature, molybdenum disulfide or tungsten disulfide is added as a solid lubricant agent. The molybdenum disulfide and tungsten disulfide of the solid lubricant agent to be added and mixed are insulating material. Due to this, when the lubricant agent is mixed singularly in a resin, it aggregates easily under influence of electrostatics and it is hard to disperse uniformly in the resin. However, according to the present invention, since the solid lubricant is mixed with the conductive graphite material first, it becomes hard to aggregate under the influence of electrostatics. Further, a binder is added and kneaded in that mixture and then pulverized. As a result of this, the solid lubricant disperse completely due to the mechanochemical effect, so that the solid lubricant is strongly adhesive bonded to the binder and the graphite powder. The mixed powder containing the graphite powder thus obtained as a primary ingredient is molded and baked into the brush material 7.

However, the brush containing the solid lubricant, such as molybdenum disulfide or tungsten disulfide, has the property that a coating is easily formed on the surfaces of the commutator during use. When the coating becomes too thick, it becomes easy to peel off. When the coating peels partly, the electric current is concentrated on that part, so that the commutating property is deteriorated. In some cases, the commutator itself may be damaged so severely that it must be replaced with a new one. Accordingly, it is preferable that the solid lubricant added is in the range of 0.5–10 parts by weight of the total weight of the brush material. This is because when the solid lubricant of less than 0.5 parts by weight is added, the lubricating property cannot be provided effectively, while on the other hand, when the solid lubricant of more than 10 parts by weight is added, an excess coating is formed on the surfaces of the commutator, so that the commutating property is deteriorated.

In addition, an abrasive is added to the brush material, to regulate the coating on the surfaces of the commutator formed by the solid lubricant agent. Alumina, silica and silicon carbide can be cited as the abrasive that may be used. When the abrasive added is large in quantity, excessively large in particle diameter, or aggregates, rather than disperses uniformly, that leads to the damage of the surfaces of the commutator. Accordingly, it is preferable that the abrasive added is in the range of 0.1–1.5 parts by weight of the total weight of the brush material. This is because when the abrasive of less than 0.1 parts by weight is added, the coating regulating function cannot be provided effectively, while on the other hand, when the abrasive of more than 1.5 parts by weight is added, there may be possibility that the surfaces of the commutator may be damaged by the abrasive. Also, when the abrasive having a particle diameter layer than 100 $\mu$m is added, the excessive grinding operation is broken out, so that the surfaces of the commutator are roughened and worn largely, while on the other hand, when the abrasive having a particle diameter finer than 5 $\mu$m is added, the operation to remove the coating on the commutator is deteriorated. Hence, the particle diameter of the abrasive is preferably in the range of 5–100 $\mu$m. Since these abrasives have a high affinity to the resin and high dispersibility, they may be added and mixed with the solid lubricant in the initial stage or may be added and mixed after the graphite powder, the binder and lubricant agent are kneaded and pulverized.

Figure 4:
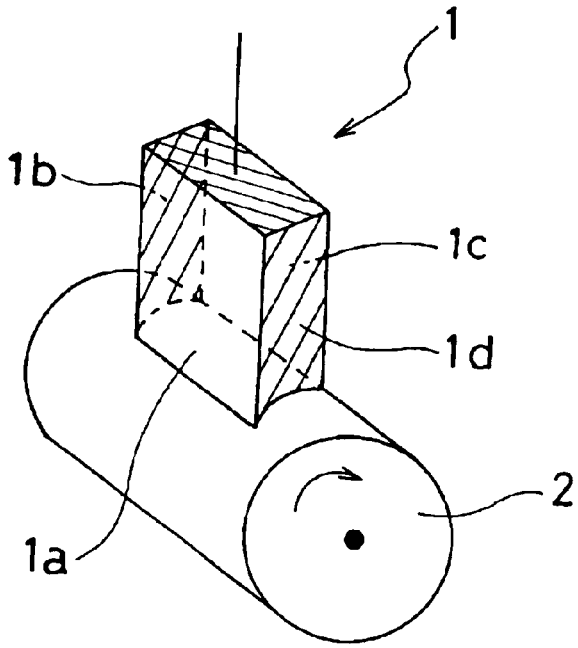
FIG. 4 is a schematic perspective view of yet another embodiment of the commutator motor in which the brush of the present invention is used.
Figure 5:
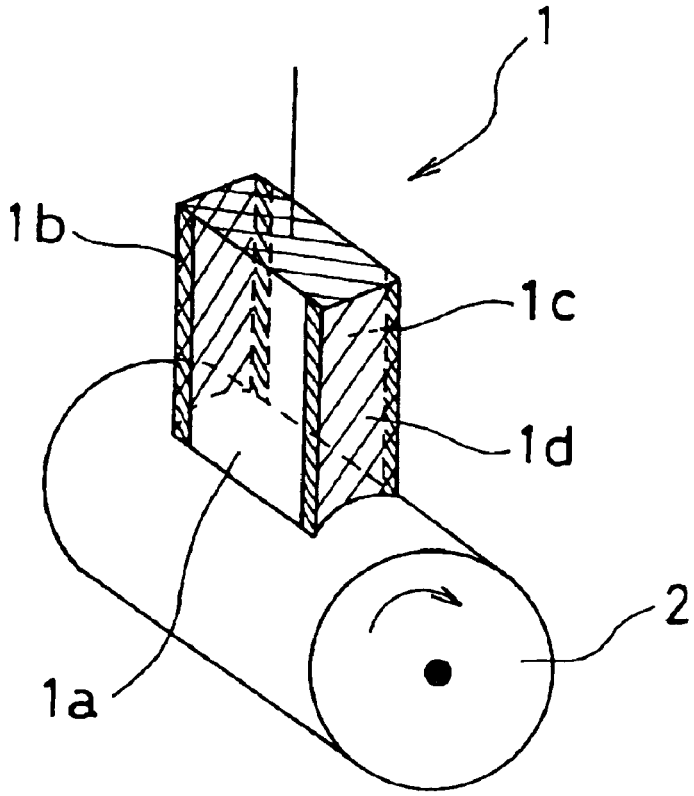
FIG. 5 is a schematic perspective view of a further embodiment of the commutator motor in which the brush of the present invention is used.
Figure 6:
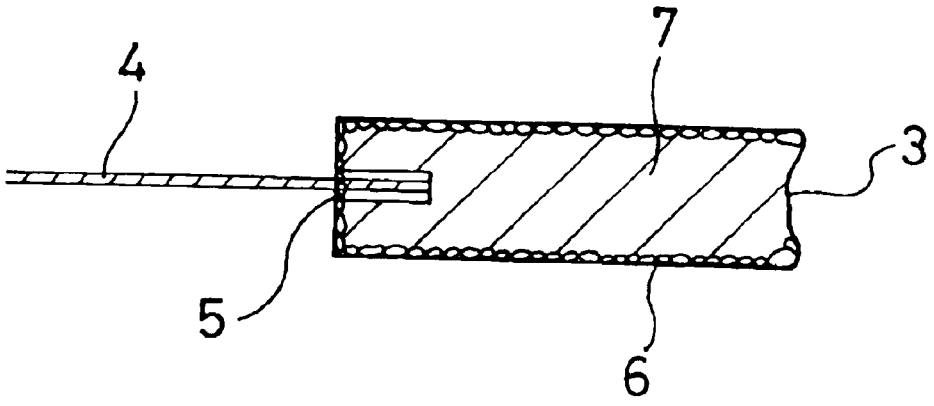
FIG. 6 is a sectional view of the brush shown in FIG. 1.

In the following, the present invention will be described with reference to the accompanying drawings. FIG. 1 is a perspective view of an example of a commutator motor using the brush whose side surfaces are all coated with a copper coating. FIGS. 2 to 5 show embodiments of the brush of the present invention and FIG. 6 shows a sectional view of the brush of FIG. 1. In the drawing figures, 1 denotes a brush, 2 denotes a commutator, 3 denotes a brush sliding surface, 4 denotes a lead wire, 5 denotes a lead wire embedding portion, 6 denotes a metallic coating, and 7 denotes a brush material.

The brush material 7 can be formed in the following manner. The artificial graphite powder and the high temperature solid lubricant, such as molybdenum disulfide and tungsten disulfide, are mixed, first. Although the high temperature lubricant agent, which is insulative and so soft, aggregates easily under influence of electrostatics and is hard to disperse, it can be made to disperse relatively easily when mixed with the conductive graphite powder. Then, the thermosetting resin as the binder is added and kneaded in the mixed powder. Thereafter, the mixture is pulverized into powder having particle size of not more than 40 mesh. Then, the abrasive is mixed in the mixed powder and then is molded into predetermined configuration and size and then baked. As a result of this, the high temperature lubricant agent and the abrasive are completely dispersed and bonded with the binder resin and the graphite powder.

Then, a metallic coating 6 is formed on surfaces of the brush 1. The metallic coating 6 can be formed in any of the known metal coating methods, including electrolytic plating, electroless plating, vacuum deposition, ion plating, and cluster ion beam. Among others, the electroless plating is particularly preferable for forming a metallic coating on the surfaces of the porous carbon material like the brush material of the present invention in which carbon of good electric conductor and resin part of bad electric conductor are mixed.

The way of the electroless plating can properly be selected from the known ways disclosed by a variety of literature. For example, reference can be made to the literature of "*Electroless plating*" (KANBE Tokuzo, Maki-Shoten Press, 1986) containing the detailed description of the electroless plating. By using this electroless plating way, a strong coating can be formed on the surfaces of the brush material according to the present invention.

The metallic coating 6 should have an adequate thickness. When the metallic coating is too thick, it roughens a sliding surface of the counterpart to provide an increased wear of the brush 1 and the counterpart material (the commutator 2). On the other hand, when the metallic coating is excessively thin, it cannot provide an effective proof coating effect for the brush and cannot provide a reduced resistance for the brush 1. As a result of this, it comes to be hard to suppress the temperature rise of the brush 1. Accordingly, the thickness of the metallic coating 6 should preferably be in the range of about 3 $\mu$m to about 100 $\mu$m.

It is preferable that an oxidation resisting coating is previously formed on the surfaces of the metallic coating 6. The oxidation resisting coating can be formed by applying acrylic resin, unsaturated fatty acid, tartaric acid and the like to the surfaces of the metallic coating 6. The oxidation resisting coating may be formed before the metallic coating 6 is mechanically removed as mentioned later or after the metallic coating 6 is mechanically removed.

Any metals may be used as the metals to be coated with the metallic coating 6, as long as those are the metals that can be plated on the surfaces of the brush material 7 in the electroless plating or can be deposited thereon. In general, copper, silver, nickel or gold is preferable in terms of production costs and ease of coating.

Figure 2:
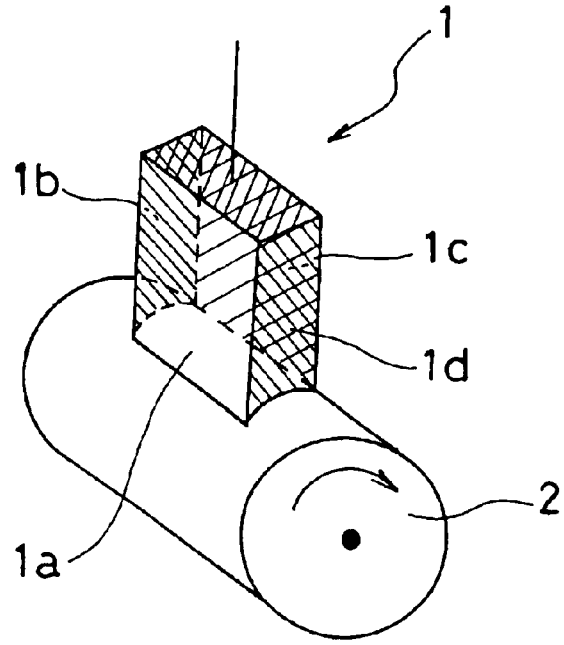
FIG. 2 is a schematic perspective view of an embodiment of the commutator motor in which the brush of the present invention is used.
Figure 3:
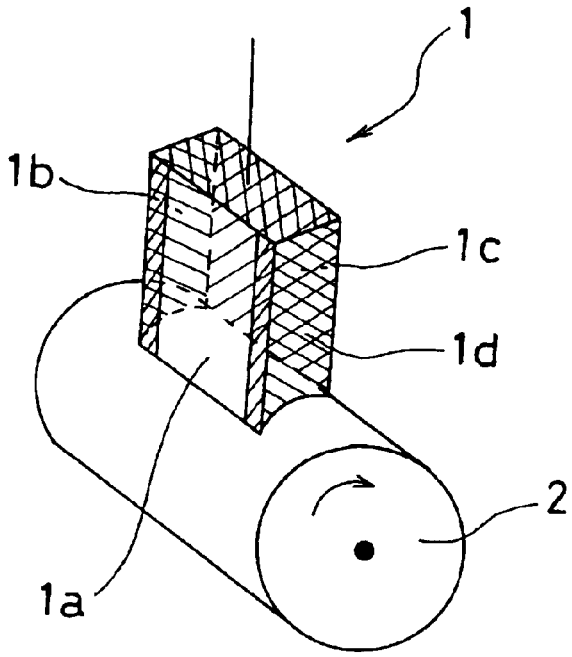
FIG. 3 is a schematic perspective view of another embodiment of the commutator motor in which the brush of the present invention is used.

If desired, the metallic coating 6 thus formed may not be formed on the brush sliding surface 3. Alternatively, the metallic coating 6, after formed on the whole surfaces of the brush, may be mechanically removed from the plane corresponding to the brush sliding surface 3. Further, as shown in FIG. 2, the metallic coating 6 may not be formed on the whole area of either of the side surfaces 1*a* of the carbon brush being a left side in case of clockwise rotation (or, not illustrated, the side surface 1*c* of the carbon brush being a right side in case of counterclockwise rotation). Alternatively, the metallic coating 6, after formed on the whole surfaces of the brush, may be mechanically removed from the corresponding plane. Or, as shown in FIG. 3, the metallic coating 6 may not be formed on the whole area of either of the side surfaces 1*a,* 1*c* of the brush except the corners or on a part of lower half planes of the side surfaces 1*a,* 1*c,* not shown. Alternatively, the metallic coating 6, after formed on the whole surfaces of the brush, may be mechanically removed from the corresponding plane. For example, when the brush material 7 is worn, is the metallic coating 6 formed on the whole surface of the brush material as shown in FIG. 1 that is brought into abutment and contact with the commutator 2. As a result of this, a part of the metallic coating 6 is caught up by the rotating commutator 2 and is stripped off with ease on that impact. In this case, the stripped part of the metallic coating 6 sometimes scratches the surface of the commutator 2. To avoid this problem, the metallic coating 6 is mechanically removed from at least a part of the surface 1*a* so that the carbon material in that region can be exposed therefrom. The exposed surface of the carbon material may be formed, for example, in the manner that when the metallic coating is formed, a surface to be formed as the exposed surface is masked so that the metallic coating cannot be formed on that surface of the carbon material. Further, if desired, as shown in FIGS. 4 and 5, the metallic coating 6 may not be formed on at least a part of the surface 1*c* opposite to the surface 1*a* as well as on the surface 1*a*. Alternatively, the metallic coating 6, after formed on those surfaces as well, may be mechanically removed from those surfaces. This can provide the advantageous effect of avoiding a possible problem that a part of the metallic coating 6 is stripped off during commutating, so that it gets into the space between the brush and the rotating commutator 2 or roughens the surface of the commutator 2.

The lead wire 4 is embedded in the brush material 7 in any proper manner, such as, for example, forming a lead wire fitting hole in the brush material and embedding the lead wire 4 in the fitting hole, so that the lead wire 4 can be integrally combined with the brush material 7. The lead wire 4 fitting hole may be formed before the metallic coating 6 is formed on the brush material or after the metallic coating 6 is formed on the brush material.

In the following, the present invention will be described in detail, with reference to Examples of the present invention.

EXAMPLE 1

70 parts by weight of artificial graphite powder having a mean particle diameter of 40 $\mu$m and an ash content of not more than 0.2%, 4.7 parts by weight of tungsten disulfide and 0.3 parts by weight of silicon carbide having a mean particle diameter of 50 $\mu$m were mixed. Then, 25 parts by weight of resol type phenol resin and methanol were added to the mixture and kneaded at room temperature for two hours. After methanol was evaporated by drying, the mixture was pulverized into powder having a particle diameter of not more than 40 mesh and then the powdered mixture was shaped to a size of 7×11×30 mm at a pressure of 200 MPa. Then, the shaped materials were baked at 600° C. in an atmosphere of nitrogen for five hours, to obtain a brush material having electric resistivity of 500 $\mu\Omega\cdot$m. This brush material was immersed in copper sulfate solution complexed by the addition of sodium hydroxide and potassium tartrate and, then, formalin as a reducing agent was added to the solution to form a copper coating of 10 $\mu$m on the surfaces of the brush material. Then, the copper coating thus formed was removed by grinding from the surface corresponding to the left side surface 1*a* with respect to the rotation direction of the commutator which is a clockwise direction (the direction A) (See FIG. 2). The lead wire was fitted to the brush material thus formed and a front end of the brush material was worked to have a curvature corresponding to a curvature of the commutator to produce a specimen under test.

EXAMPLE 2

Except that the artificial graphite powder of high alignment and ease of forming, having a mean particle diameter of 15 $\mu$m and an ash content of not more than 0.5% was used, the same operation as in Example 1 was conducted to produce the brush material having the electric resistivity of 100 $\mu\Omega\cdot$m. Subsequently, the same operation as in Example 1 was conducted to produce a specimen under test.

EXAMPLE 3

70 parts by weight of artificial graphite powder having a mean particle diameter of 40 μm, 4.7 parts by weight of molybdenum disulfide as a solid lubricant, 0.3 parts by weight of silicon carbide as an abrasive and 25 parts by weight of bisphenol type epoxy resin and acid-anhydride type curing agent were added and kneaded at 130° C. for one hour. The powdered mixture was shaped in the same manner as in Example 1 and then cured at 220° C., to obtain a brush material having a electric resistivity of 2,000 μΩ·m. Subsequently, the same operation as in Example 1 was conducted to produce a specimen under test.

COMPARATIVE EXAMPLE 1

The same operation as in Example 1 was conducted to produce a brush material, except that the copper coating was not formed on the brush material. The brush material thus produced was used as a specimen under test as.

COMPARATIVE EXAMPLE 2

The same method as in Example 1 was used to produce a brush material, except that tungsten disulfide and silicon carbide were not used. Subsequently, the same operation as in Example 1 was conducted to produce a specimen under test.

COMPARATIVE EXAMPLE 3

Except that the artificial graphite powder having a mean particle diameter of 40 μm and an ash content of not more than 0.5% and being higher in ease of forming (higher in crystallinity) than the artificial graphite powder of Example 2 was used, the same method as in Example 1 was used to produce the brush material having elctric resistivity of 60 μΩ·m. Subsequently, the same operation as in Example 1 was conducted to produce a specimen under test.

Measurements were made of the temperature rise and the wearing rate of the specimens of Examples 1 to 3 and Comparative Examples 1 to 3. Measurements were also made of the electric resistivity (apparent resistivity) of the whole brush on which the metallic coating was formed.

(Measurement of Temperature Rise)

A small hole was bored from the lead wire fitting surface of the specimen to the depth of 3 mm from a contact surface of the specimen with the commutator, and a thin thermocouple (JIS-Grade 0.75) was inserted in the hole and connected with a motor for electric vacuum cleaner of a rated volume of 220V and 1 kW. With the motor driven at a rated speed, the temperature rise was measured.

(Measurement of Wearing Rate)

After the motor mounting thereon the specimen of the brush connected with no thermocouple was driven at a rated speed for 100 hours, the wearing rate of the brush mounted on the motor was measured.

(Measurement of Electric Resistivity of Brush Material)

The test piece having a size of 5×5×30 mm was used for measurement of the electric resistivity of the brush material. The electric resistivity of the brush material was calculated by using the following equation and the calculated value was rounded off to an integer.

$$\rho=(V\times A)/(I\times L)\}\times 10^{-3}$$

where ρ is an electric resistivity (μΩ·m); V is a voltage (mV) between voltage terminals; I is a current (A) flowing through the test piece; A is a sectional area ($m^2$) of the test piece; and L is a distance (m) between the voltage terminals.

(Measurement of Apparent Resistivity of Brush)

The test piece having a size of 7×11×30 mm was used for measurement of the apparent resistivity of the brush. The resistivity of the brush was measured in accordance with the measuring method of the brush material mentioned above.

(Measurement of Coating Thickness of Metallic Coating)

The coating thickness of the metallic coating was measured by cutting the brush and measuring a thickness from a boundary between the brush material and the coated metal to a top end of the coating layer of the brush with a scanning electron microscope (hereinafter it is simply referred to as "SEM").

These measurement results are all shown in FIG. 7.

Following facts were found from the results of FIG. 7. In the brushes of Examples 1–3, although the brush material has a high resistivity, since molybdenum disulfide or tungsten disulfide, and silicon carbide were added and the copper-plated coating is formed on the surfaces of the brush material, a reduced apparent resistivity is produced by the copper coating formed on the surfaces of the brush material and also the wearing rate is also reduced, from which it can be seen that an improved durability of the brush can be produced.

In contrast to this, in the specimen of Comparative Example 1 in which tungsten disulfide and silicon carbide were added but the copper-plated coating is not formed on the surfaces of the brush material, although the wearing rate was small in the initial stage, the surface of the commutator was roughened with time and the wearing rate of the brush was gradually increased, to eventually cause the burning of the lead wire. Also, the temperature rise is also increased, as compared with the specimen of Example 1, from which it can be seen that the copper coating can provide the effect of suppressing the temperature rise of the brush.

In the specimen of Comparative Example 2 in which molybdenum disulfide or tungsten disulfide of the solid lubricant agent and silicon carbide of the abrasive were not added and the copper-plated coating was formed on the surfaces of the brush material, the wearing rate was increased by about 1.4–1.8 times that of the brushes of Examples 1–3.

In the specimen of Comparative Example 3, since the electric resistivity of the brush material was lower than that of the brush material of Examples 1–3 and resultantly the commutating property was inferior to the other specimens and an increased wearing rate was produced. In contrast, in Example 3, in particular, the presence of the curing agent for the binder resin of the insulating material provided a relatively large resistivity and a good commutating property and the smallest wearing rate was provided. Also, it was found that the use of the molybdenum disulfide as the solid lubricant agent could provide the effect of reducing the wearing rate of the brush, as is the case with the use of tungsten disulfide.

It was found further that since the copper coating formed on the brush material was removed from the whole area of the front side of the brush orthogonal to the rotation direction of the commutator, the coating of the brush was prevented from being stripped or drooped during commutating, thus preventing roughening the surface of the commutator.

CAPABILITY OF EXPLOITATION IN INDUSTRY

According to the present invention thus constructed, the solid lubricant and the graphite powder is blended, first, and, then, the mixture is mixed with the binder such as the thermosetting resin and the like, whereby the solid lubricant is dispersed uniformly in the binder. Also, since the brush material is made to have the resistivity of 100–200 $\mu\Omega\cdot$m and also the metal coating of good electric conductor is formed on the surface of the brush, the temperature rise of the brush can be suppressed. By virtue of this, despite of the high power and high-velocity revolution, stable rectification can be maintained for a long term. In addition, since the abrasive having a relatively rough particle diameter can be used, the current-carrying parts of the brush are stably provided by the scratch effect of the abrasive and, as a result of this, the electric current for braking can be effectively provided during the braking without hindrance. Accordingly, the brush of the present invention is suitably applicable to power tools, particularly to power tools with electric brake. Further, since the oxidation resistance film is formed on the surfaces of the metallic coating of good electric conductor formed on the surface of the brush material, the effect of the metallic coating of good electric conductor can be maintained for a long term. Moreover, when the commutator rotates clockwise, since the metal coating of the good electric conductor is removed from at least a part of at least either of a left side surface or a right side surface, it can be used as a brush showing the stable rectification without scratching the surface of the commutator by stripping off during the rectification.

What is claimed is:

1. A carbon brush for electric machinery comprising:

a carbon brush material configured to be abutted against a conductive rotary member; and a conductive metal coating formed on the material, wherein a part of one side surface of the material configured to be disposed orthogonal to a rotation direction of the conductive rotary member does not include the metal coating.

2. The carbon brush for electric machinery according to claim 1, wherein parts of two side surfaces of the material configured to be disposed orthogonal to the rotation direction of the conductive rotary member do not include the metal coating.

3. The carbon brush for electric machinery according to claim 2, wherein the carbon brush material has electric resistivity of not less than 100 $\mu\Omega\cdot$m.

4. The carbon brush for electric machinery according to claim 2, further comprising:

an oxidation resisting coating formed on a surface of the metal coating.

5. The carbon brush for electric machinery according to claim 2, wherein a part of a front surface of the material configured to be disposed orthogonal to the rotation direction of the conductive rotary member does not include the metal coating.

6. The carbon brush for electric machinery according to claim 5, comprising:

an oxidation resistant coating comprising at least one acrylic resin, unsaturated fatty acid, and tartaric acid disposed on a surface of the metal coating.

7. The carbon brush for electric machinery according to claim 6, wherein the carbon brush material comprises a solid lubricant and an abrasive.

8. A carbon brush for electric machinery comprising:

a carbon brush material configured to be abutted against a conductive rotary member; and a conductive metal coating formed on the material, wherein parts of two side surfaces of the material configured to be disposed orthogonal to a rotation direction of the conductive rotary member do not include the metal coating.

9. The carbon brush for electric machinery according to claim 8, comprising:

an oxidation resistant coating comprising at least one acrylic resin, unsaturated fatty acid, and tartaric acid disposed on a surface of the metal coating.

10. The carbon brush for electric machinery according to claim 9, wherein the carbon brush material comprises a solid lubricant and an abrasive.

* * * * *